US010469943B2

(12) United States Patent
Xie et al.

(10) Patent No.: US 10,469,943 B2
(45) Date of Patent: Nov. 5, 2019

(54) LOUDSPEAKER ASSEMBLY

(71) Applicant: Guoguang Electric Corp. LTD, Guangzhou (CN)

(72) Inventors: Shouhua Xie, Guangzhou (CN); Hanxiong Huang, Guangzhou (CN)

(73) Assignee: GUOGUANG ELECTRIC CORP. LTD, Guangzhou (CN)

( * ) Notice: Subject to any disclaimer, the term of this patent is extended or adjusted under 35 U.S.C. 154(b) by 0 days.

(21) Appl. No.: 15/504,308

(22) PCT Filed: Feb. 14, 2017

(86) PCT No.: PCT/CN2017/073482

§ 371 (c)(1),
(2) Date: Feb. 15, 2017

(87) PCT Pub. No.: WO2018/148865

PCT Pub. Date: Aug. 23, 2018

(65) Prior Publication Data

US 2019/0090049 A1 Mar. 21, 2019

(51) Int. Cl.

| | |
|---|---|
| ***H04R 1/20*** | (2006.01) |
| ***H04R 1/34*** | (2006.01) |
| ***H04R 1/02*** | (2006.01) |
| ***H04R 1/30*** | (2006.01) |

(52) U.S. Cl.

CPC ..... *H04R 1/345* (2013.01); *H04R 1/025* (2013.01); *H04R 1/30* (2013.01)

(58) Field of Classification Search

CPC . H04R 1/02; H04R 1/021; H04R 1/20; H04R 1/34; H04R 1/30; H04R 1/32; H04R 1/345

See application file for complete search history.

(56) References Cited

U.S. PATENT DOCUMENTS

| | | | | |
|---|---|---|---|---|
| 9,549,237 | B2 * | 1/2017 | Devantier | H04R 1/021 |
| 2008/0110692 | A1 | 5/2008 | Moore | |
| 2012/0201403 | A1 * | 8/2012 | Tan | H04R 1/345 381/182 |

FOREIGN PATENT DOCUMENTS

| | | | |
|---|---|---|---|
| CN | 106068005 | A | 11/2016 |
| CN | 106101938 | A | 11/2016 |

OTHER PUBLICATIONS

PCT/CN2017/073482. International Search Report & Written Opinion (dated Nov. 17, 2017).

* cited by examiner

*Primary Examiner* — Amir H Etesam
(74) *Attorney, Agent, or Firm* — Loza & Loza, LLP; Julio M. Loza

(57) ABSTRACT

Aspects of the present disclosure related to an apparatus and method for radiating sound waves in an omnidirectional manner. A loudspeaker assembly includes a first electro-acoustic transducer positioned along a first longitudinal axis and configured to generate one of low frequency sound waves or high frequency sound waves, a second electro-acoustic transducer positioned along a second longitudinal axis and configured to generate another one of the low frequency sound waves or the high frequency sound waves, and a waveguide and phase plug assembly, coupled between the first electro-acoustic transducer and the second electro-acoustic transducer, and configured to control a direction in which the sound waves generated by the first electro-acoustic transducer and the second electro-acoustic transducer are radiated.

20 Claims, 11 Drawing Sheets

1100

1200

1300

1400

LOUDSPEAKER ASSEMBLY

CROSS-REFERENCE TO RELATED APPLICATIONS

This application is the U.S. national stage of International Patent Application No. PCT/CN2017/073482 filed on Feb. 14, 2017 and entitled LOUDSPEAKER ASSEMBLY. The disclosure of the foregoing application is incorporated herein by reference in its entirety.

BACKGROUND

Field

The present disclosure relates generally to audio devices, and more particularly, to a loudspeaker assembly that effectively reproduces sound with controlled directivity.

Background

A speaker converts electrical signals to sound waves that allows a listener to enjoy amplified sounds. One of the factors that determines the quality of the speaker-generated sound heard by the listener is a sound pressure level (SPL). The SPL generally depends on the size of the speaker relative to the distance between the speaker and the listener.

Conventional speakers produce audible sounds by displacing air via the movement of a diaphragm. Specifically, the diaphragm (e.g., often referred to as a dome, membrane, cone, etc.) is attached to a voice coil former (sometimes also referred to as a bobbin) and moves under the control of a voice coil through which electric current associated with the sounds to be reproduced. The voice coil is typically disposed in an annular air gap defined by a permanent magnet that provides radial magnetic flux in the air gap. Lead wires provide the electric current to the voice coil which interacts with the magnetic flux to provide axial forces on the voice coil and voice coil former which displace the voice coil, former, and the diaphragm (e.g., causing an up and/or down movement along an central axis). The displacement or movement of the voice coil and former may be controlled by the magnitude and direction of current in the voice coil and the resulting axial forces.

A conventional loudspeaker system generally includes an enclosure supporting at least one electro-acoustic transducer. One type of loudspeaker system may incorporate at least one waveguide to take advantage of a waveguide's favorable properties. Conventional loudspeaker systems, especially those designed to produce low frequencies, are often large, heavy and cumbersome thereby making transport of such systems difficult.

An omnidirectional speaker is a speaker which provides a sound field which allows a person positioned in any direction around the speaker to hear the wide bandwidth (frequency range) sound produced by the speaker. Such a speaker utilizes drivers, which are transducers that convert electricity to various ranges of sound. A diaphragm in the driver may be electrically induced in a back-and-forth motion to create pressure waves in a column of air in front of the driver, and at some angles to the sides. The diaphragm may typically be in the shape of a cone.

Multiple drivers may be used to enhance sound quality, where the different drivers used may include low frequency drivers (woofers or sub-woofers) that produce sound in a low frequency range, midrange frequency drivers that produce sound in a middle frequency range, and high frequency drivers (tweeters) that produce sound in a high frequency range. Breaking up a sound signal in this manner may advantageously cover the range of sounds a human can hear, e.g., 20 Hz to 20,000 Hz.

A wide variety of speaker designs have been created in an effort to enhance sound quality. For example, a known speaker design provides for a speaker including a pair of drivers, one high frequency driver (tweeter) and one midrange frequency driver, with each driver aligned in the same direction. Each driver is also provided with a conical shaped dispersion surfaces. However, such conical shaped waveguides may be less than ideal since irregular surfaces, such as the tip of the conical shaped dispersion surface, may introduce distortions in sound quality. The irregular surfaces may produce reflections in sound waves which are out of phase with other sound waves generated by the speaker, and can also result in reinforcement of some frequencies and cancellation of others.

In another example speaker design, a pair of drivers are coaxial and face each other, and each driver is provided with a dome (waveguide). However, such a design may have the effect of introducing distortions in sound quality, e.g., when the diameter of the domes/waveguides is less than the diameter of the drivers, and the domes/waveguides have a flat reflecting surface.

Ideally, an omnidirectional speaker reproduces sound at a point, the sound radiates outward from the point in all directions, and diverging sound waves are free of interferences. Accordingly, it would be desirable to provide an omnidirectional speaker with a plurality of drivers that provides enhanced and consistent sound quality, reduced background noise and distortion, and well-distributed sound dispersion.

SUMMARY

Aspects of the present disclosure provide systems, methods, and apparatuses for radiating sound waves in an omnidirectional manner.

An apparatus may be a loudspeaker assembly including a downward-facing electro-acoustic transducer configured to generate one of low frequency sound waves or high frequency sound waves, an upward-facing electro-acoustic transducer configured to generate another one of the low frequency sound waves or the high frequency sound waves, and a waveguide and phase plug assembly, coupled between the downward-facing electro-acoustic transducer and the upward-facing electro-acoustic transducer, and configured to control a direction in which the sound waves generated by the downward-facing electro-acoustic transducer and the upward-facing electro-acoustic transducer are radiated.

The downward-facing electro-acoustic transducer and the upward-facing electro-acoustic transducer face each other and are aligned along a same axis. The waveguide and phase plug assembly controls the sound waves generated by the downward-facing electro-acoustic transducer and the upward-facing electro-acoustic transducer to be radiated in a 360-degree direction.

The waveguide and phase plug assembly is further configured to increase impedance matching and air loading of the downward-facing electro-acoustic transducer and the upward-facing electro-acoustic transducer. The waveguide and phase plug assembly includes a waveguide configured to directionally guide the sound waves generated by the downward-facing electro-acoustic transducer and the upward-facing electro-acoustic transducer, and a phase plug, integrated with the waveguide, and configured to equalize path lengths of the sound waves generated by at least one of the downward-facing electro-acoustic transducer or the upward-facing electro-acoustic transducer to prevent sound wave cancellation.

The downward-facing electro-acoustic transducer may be configured to generate the low frequency sound waves and may have a concave shape with respect to the waveguide. The upward-facing electro-acoustic transducer may be configured to generate the high frequency sound waves and includes a diaphragm. The phase plug may be disposed between the diaphragm and the waveguide.

The waveguide includes a number of wedge inserts that control the direction in which the sound waves generated by the downward-facing electro-acoustic transducer and the upward-facing electro-acoustic transducer are radiated. The downward-facing electro-acoustic transducer and the upward-facing electro-acoustic transducer are electrically fed in phase.

In an aspect, a first cell includes the downward-facing electro-acoustic transducer, the upward-facing electro-acoustic transducer, and the waveguide and phase plug assembly coupled between the downward-facing electro-acoustic transducer and the upward-facing electro-acoustic transducer. The loudspeaker assembly may further include at least one other cell stacked above or below the first cell. The at least one other cell may include at least one other downward-facing electro-acoustic transducer configured to generate one of low frequency sound waves or high frequency sound waves, at least one other upward-facing electro-acoustic transducer configured to generate another one of the low frequency sound waves or the high frequency sound waves, and at least one other waveguide and phase plug assembly, coupled between the at least one other downward-facing electro-acoustic transducer and the at least one other upward-facing electro-acoustic transducer, and configured to control a direction in which the sound waves generated by the at least one other downward-facing electro-acoustic transducer and the at least one other upward-facing electro-acoustic transducer are radiated.

The loudspeaker assembly may further include a speaker enclosure for electrically coupling components of the loudspeaker assembly, one or more passive radiators formed at a side portion of the speaker enclosure and configured to tune a frequency response of the sound waves generated by the downward-facing electro-acoustic transducer and the upward-facing electro-acoustic transducer, and an outer housing for enclosing the downward-facing electro-acoustic transducer, the upward-facing electro-acoustic transducer, the waveguide and phase plug assembly, the speaker enclosure, and the one or more passive radiators.

A method for radiating sound waves in an omnidirectional manner via a loudspeaker assembly, includes generating low frequency sound waves via a first electro-acoustic transducer positioned in one of a downward-facing direction or an upward-facing direction in the loudspeaker assembly, generating high frequency sound waves via a second electro-acoustic transducer positioned in another one of the downward-facing direction or the upward-facing direction in the loudspeaker assembly, and controlling a direction in which the sound waves generated via the first electro-acoustic transducer and the second electro-acoustic transducer are radiated using a waveguide and phase plug assembly, wherein the waveguide and phase plug assembly is coupled between the first electro-acoustic transducer and the second electro-acoustic transducer.

A loudspeaker assembly for radiating sound waves in an omnidirectional manner, includes first sound generating means for generating sound waves in a first frequency range, the first sound generating means positioned along one of a first longitudinal axis or a second longitudinal axis in the loudspeaker assembly, second sound generating means for generating sound waves in a second frequency range the second sound generating means positioned along another one of the first longitudinal axis or the second longitudinal axis in the loudspeaker assembly, wherein the first frequency range is lower than the second frequency range, and controlling means for controlling a direction in which the sound waves generated by the first sound generating means and the second sound generating means are radiated, wherein the waveguide and phase plug assembly is coupled between the first electro-acoustic transducer and the second electro-acoustic transducer.

The controlling means may include guiding means for directionally guiding the sound waves generated by the first sound generating means and the second sound generating means, and equalizing means, integrated with the guiding means, for equalizing path lengths of the sound waves generated by at least one of the first sound generating means or the second sound generating means to prevent sound wave cancellation.

The loudspeaker assembly may further include enclosure means for electrically coupling components of the loudspeaker assembly, tuning means, formed at a side portion of the enclosure means, for tuning a frequency response of the sound waves generated by the first sound generating means and the second sound generating means, and housing means for enclosing the first sound generating means, the second sound generating means, the controlling means, the enclosure means, and the tuning means.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well-known structures and components are shown in block diagram form in order to avoid obscuring such concepts.

The word "exemplary" or "embodiment" is used herein to mean "serving as an example, instance, or illustration." Any implementation or aspect described herein as "exemplary" or as an "embodiment" is not necessarily to be construed as preferred or advantageous over other aspects of the disclosure. Likewise, the term "aspects" does not require that all aspects of the disclosure include the discussed feature, advantage, or mode of operation.

Overview

Figure 2:
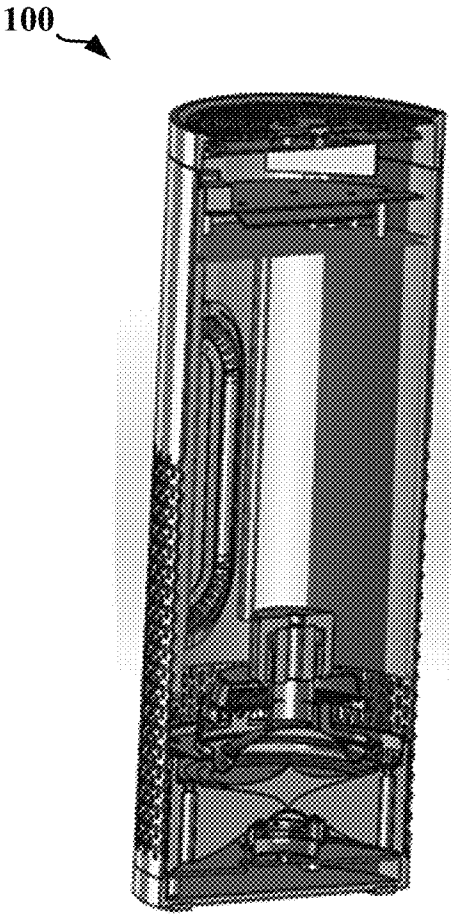
FIG. 2 illustrates a cross-sectional view of the loudspeaker assembly.
Figure 1:
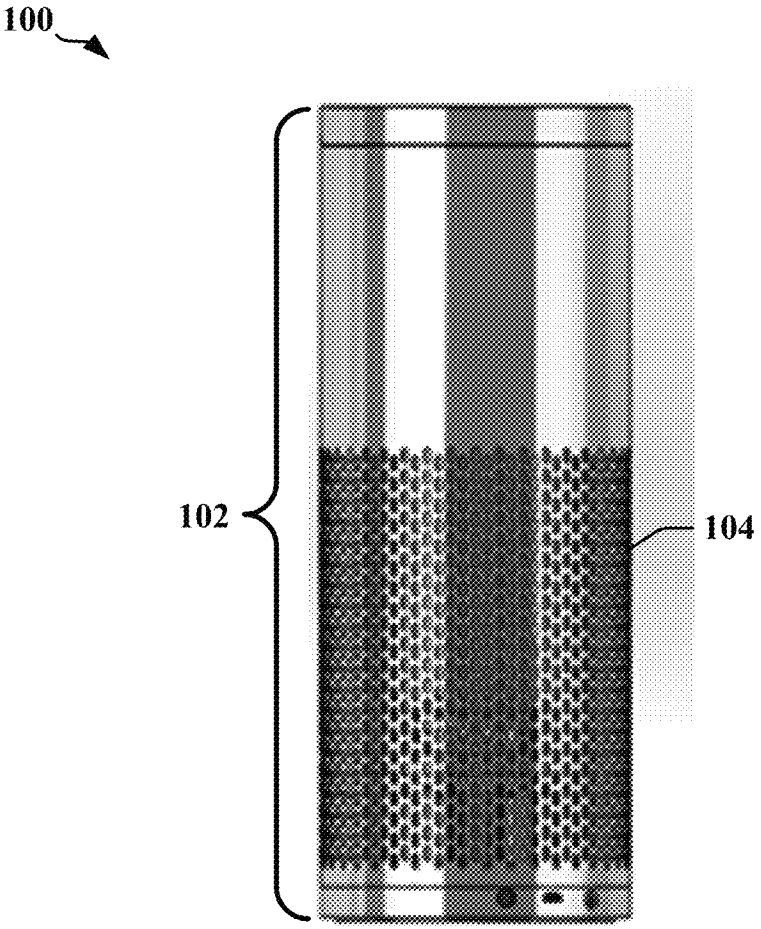
FIG. 1 illustrates a loudspeaker assembly in accordance with the present disclosure.

FIG. 1 illustrates a loudspeaker assembly 100 in accordance with the present disclosure. As shown in FIG. 1, the loudspeaker assembly 100 may include an outer housing 102. The outer housing 102 may include air vents 104 that allow sound waves to pass through. FIG. 2 illustrates a cross-sectional view of the loudspeaker assembly 100. Details regarding components housed within the loudspeaker assembly 100, as seen in FIG. 2, will be described below.

Figure 4:
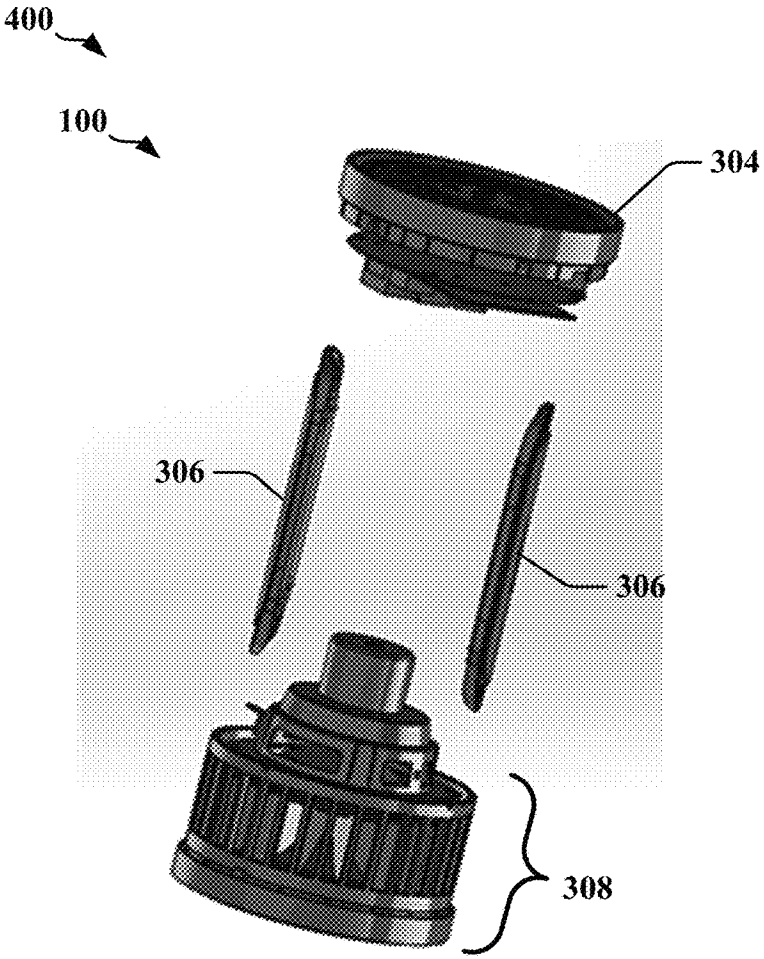
FIG. 4 is a diagram of the loudspeaker assembly excluding a speaker enclosure in accordance with the present disclosure.
Figure 3:
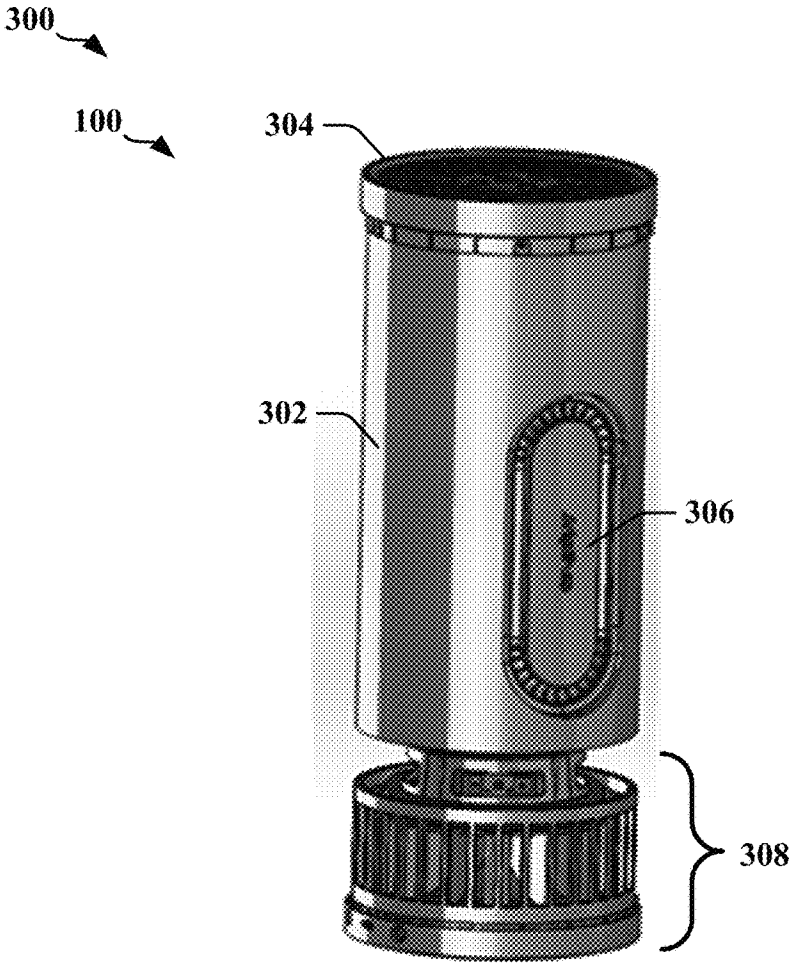
FIG. 3 is a diagram of the loudspeaker assembly excluding an outer housing in accordance with the present disclosure.

FIG. 3 is a diagram 300 of the loudspeaker assembly 100 excluding the outer housing 102 in accordance with the present disclosure. The loudspeaker assembly 100 includes a speaker enclosure 302 for electrically coupling components of the loudspeaker assembly 100. FIG. 4 is a diagram 400 of the loudspeaker assembly 100 excluding the speaker enclosure 302.

Referring to FIGS. 3 and 4, an upper cap 304 may be coupled to the assembly 100 at an upper portion of the speaker enclosure 302. Passive radiators (drone cones) 306, configured to tune a frequency response, may be disposed at side portions of the loudspeaker assembly 100 within a surface of the speaker enclosure 302. Moreover, a waveguide and phase plug assembly 308 may be coupled to the assembly 100 at a lower portion of the speaker enclosure 302.

Exemplary Embodiments

Figure 5:
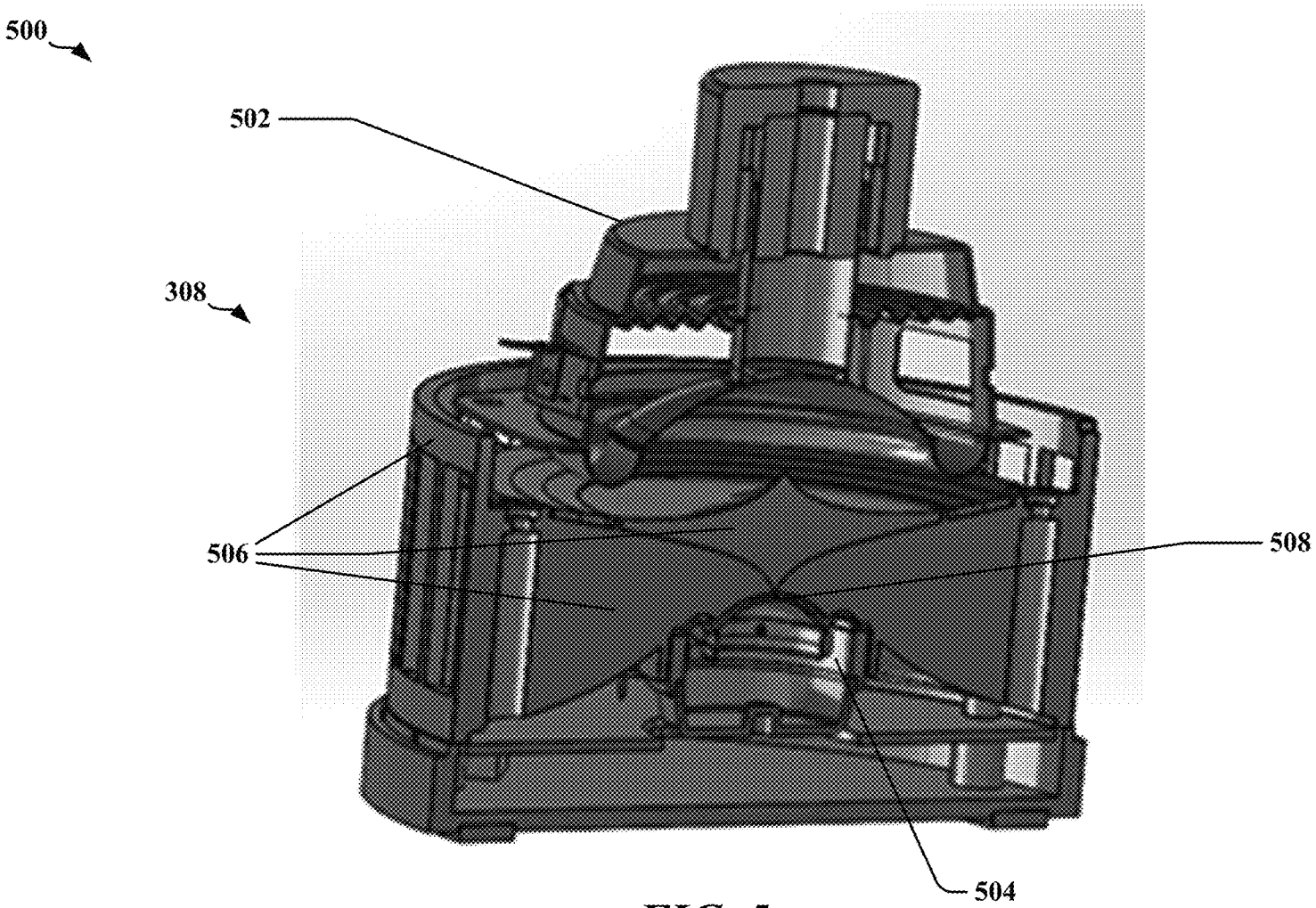
FIG. 5 is a diagram illustrating a cross-sectional view of a waveguide and phase plug assembly.

FIG. 5 is a diagram 500 illustrating a cross-sectional view of the waveguide and phase plug assembly 308. The waveguide and phase plug assembly 308 may include a waveguide 506 integrated with a phase plug 508. In an aspect of the disclosure, a low frequency driver (woofer) 502 positioned in a downward-facing direction in the loudspeaker assembly 100 may be coupled to an upper portion of the waveguide and phase plug assembly 308 and a high frequency driver (tweeter) 504 positioned in an upward-facing direction in the loudspeaker assembly 100 may be coupled to a lower portion of the waveguide and phase plug assembly 308. In other aspects of the disclosure, the woofer 502 may be positioned in the upward-facing direction and coupled to the lower portion of the waveguide and phase plug assembly 308 and the tweeter 504 may be positioned in the downward-facing direction and coupled to the upper portion of the waveguide and phase plug assembly 308. The woofer 502 and the tweeter 504 may face each other and be aligned along a same axis (i.e., coaxial with each other). The waveguide 506 and the phase plug 508 are disposed between the woofer 502 and the tweeter 504.

It is noted that the description below is directed to the woofer 502 being positioned in the downward-facing direction and facing the tweeter 504 positioned in the upward-facing direction in the loudspeaker assembly 100. However, as mentioned above, it is contemplated that the woofer 502 may be positioned in the upward-facing direction and the tweeter 504 may be positioned in the downward-facing direction. Accordingly, the description below may also apply to aspects wherein the woofer 502 is positioned in the upward-facing direction and facing the tweeter 504 that is positioned in the downward-facing direction in the loudspeaker assembly 100.

Figure 7:
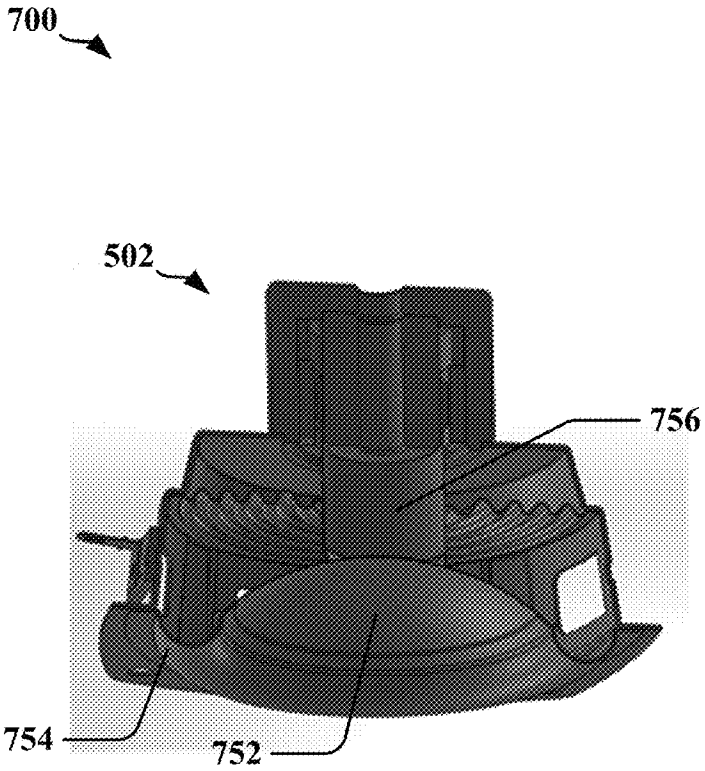
FIG. 7 is a diagram illustrating a cross-sectional view of the woofer.
Figure 6:
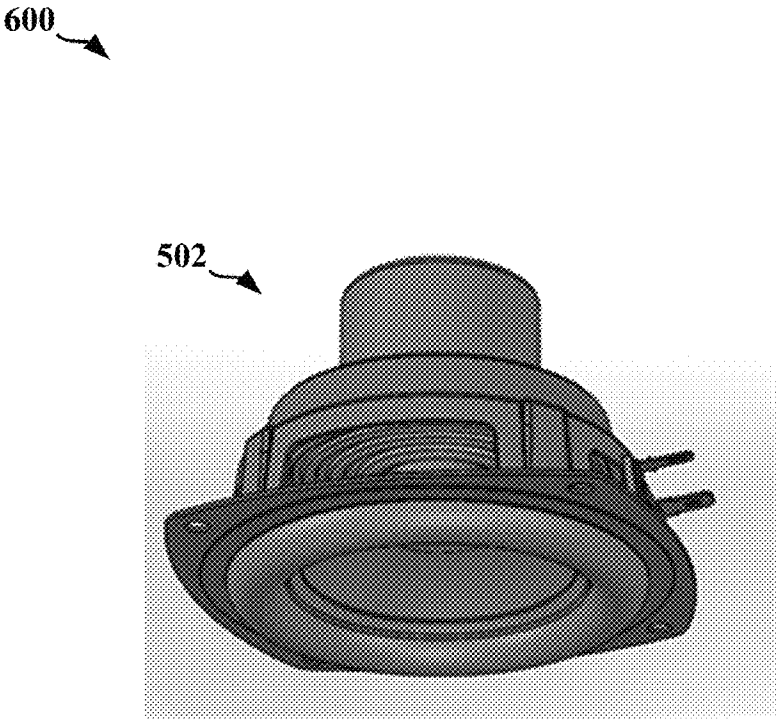
FIG. 6 is a diagram of a woofer in accordance with the present disclosure.

FIG. 6 is a diagram 600 of the woofer 502. FIG. 7 is a diagram 700 illustrating a cross-sectional view of the woofer 502. The woofer 502 is configured to radiate low frequency sound waves. As shown in FIG. 7, the woofer 502 includes a woofer diaphragm 752 coupled to a voice coil 756. A rubber surround 754 may be formed along a periphery of the diaphragm 752. In accordance with aspects of the present disclosure, the woofer 502 may also be referred to herein as a low frequency driver, a low frequency transducer sub-assembly, or a down-firing electro-acoustic transducer.

Figure 8:
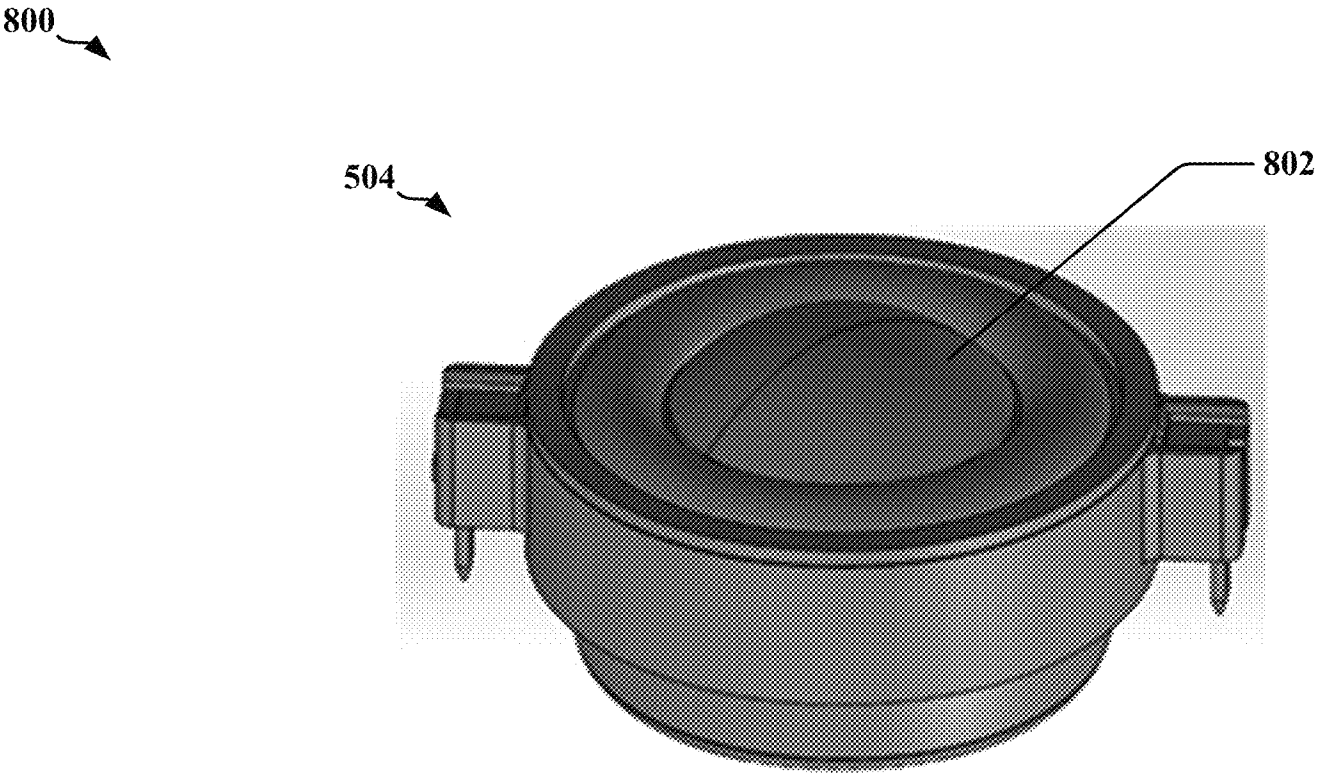
FIG. 8 is a diagram of a tweeter in accordance with the present disclosure.

FIG. 8 is a diagram 800 of the tweeter 504. The tweeter 504 is configured to radiate high frequency sound waves. As shown in FIG. 8, the tweeter 504 includes a tweeter diaphragm 802. In accordance with aspects of the present disclosure, the tweeter 504 may also be referred to herein as a high frequency driver, a high frequency transducer sub-assembly, or an up-firing electro-acoustic transducer.

Figure 10:
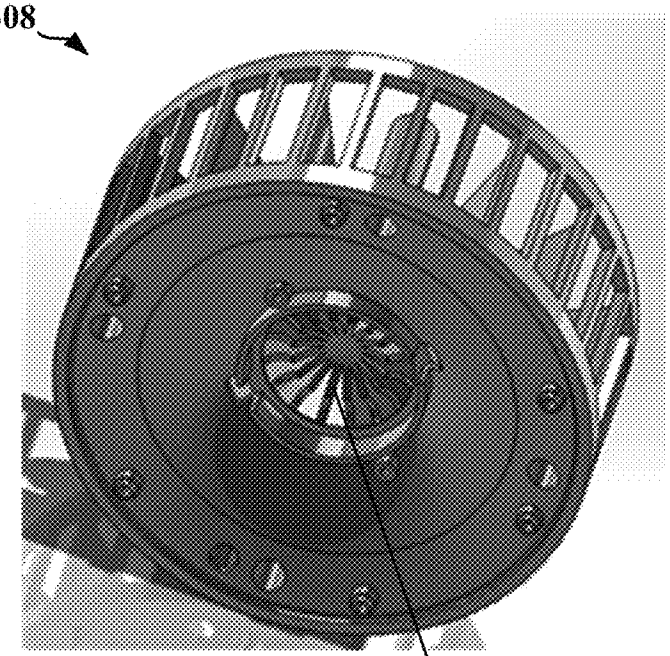
FIG. 10 is a diagram illustrating an alternate view of the waveguide and phase plug assembly excluding the woofer and the tweeter.
Figure 9:
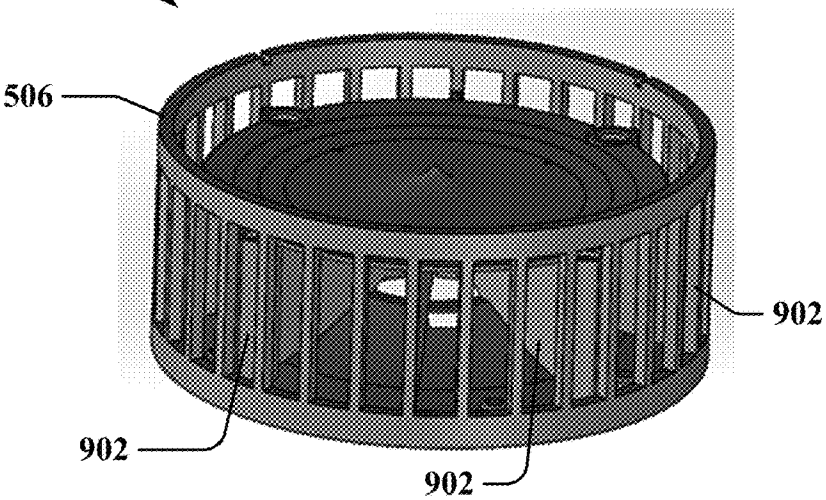
FIG. 9 is a diagram illustrating a view of the waveguide and phase plug assembly excluding the woofer and the tweeter.

FIG. 9 is a diagram 900 illustrating a view of the waveguide and phase plug assembly 308 excluding the woofer 502 and the tweeter 504. FIG. 10 is a diagram 1000 illustrating an alternate view of the waveguide and phase plug assembly 308 excluding the woofer 502 and the tweeter 504. In general, the waveguide 506 is a structure that guides sound waves generated by the woofer 502 and/or the tweeter 504 and enables a sound wave to propagate with minimal loss of energy by restricting expansion to one or two dimensions. The waveguide 506 may include a number of wedge inserts 902 to control the sound wave directivity of the loudspeaker assembly 100. The wedge inserts 902 may be tight fit and air-sealed with the waveguide 506. In general, the phase plug 508 is a mechanical interface between a driver (e.g., woofer 502 and/or tweeter 504) and a listener, and acts as an acoustical transformer that extends high frequency response by guiding sound waves outward toward the listener rather than allowing the sound waves to interact destructively near the driver. The phase plug 508 may serve to equalize sound wave path lengths from the driver to the listener, to prevent sound wave cancellations and improve frequency response.

In an aspect of the disclosure, the waveguide and phase plug assembly 308 having the waveguide 506 integrated with the phase plug 508 enhances air (acoustic) loading and sound wave radiation directivity of the loudspeaker assembly 100. The waveguide 506 may be positioned between the woofer 502 and the tweeter 504. In an example, when sound waves are generated by the woofer 502, the woofer diaphragm 752 vibrates to push air in a certain direction (e.g., vertical direction). The air may then be loaded into the waveguide 506, which directs the air to be radiated in a direction (e.g., horizontal direction) that is generally perpendicular to the direction in which the woofer diaphragm 752 pushes air.

The phase plug 508 may be positioned between the tweeter diaphragm 802 and the waveguide 506 to increase air loading and enhance speaker performance as air is radiated through the waveguide 506. The position of the phase plug 508 allows an air cavity to form between the tweeter diaphragm 802 and the phase plug 508. When sound waves are generated by the tweeter 504, the tweeter diaphragm 802 vibrates to push air in a certain direction (e.g., vertical direction). However, the presence of the phase plug 508 increases a tweeter diaphragm reaction before the air is loaded into the waveguide 506. The phase plug 508 facilitates the air to first concentrate in the air cavity prior to leaking out of slits in the phase plug 508. As the air leaks out of the slits, the phase plug 508 increases the tweeter air loading prior to the air radiating through the waveguide 506 in a direction (e.g., horizontal direction) that is generally perpendicular to the direction in which the tweeter diaphragm 802 pushes air. As such, tweeter sensitivity is increased.

Aspects of the present disclosure generally relate to an audio loudspeaker system and, in particular, a radiation pattern controlled loudspeaker system. Conventional loudspeaker systems may be designed for evenly distributed sound pressure, which have a circle-like directivity at interested frequencies. According to energy conservation laws, a loudspeaker having an omnidirectional radiation pattern may have lower sensitivities unless the loudspeaker utilizes acoustic hard boundaries to boost a sound pressure level (SPL). For example, one acoustic hard boundary may boost 3 dB sensitivity.

In an aspect of the present disclosure, a loudspeaker assembly 100 having a configuration of one down-firing electro-acoustic transducer (woofer) 502 and one up-firing electro-acoustic transducer (tweeter) 504 using a loudspeaker landing plane facilitates each of the down-firing electro-acoustic transducer (woofer) 502 and the up-firing electro-acoustic transducer (tweeter) 504 to have a sensitivity of approximately 3 dB higher than a sensitivity each transducer would normally have in a three-dimensional free space.

In an aspect of the present disclosure, the waveguide and phase plug assembly 308 operate with the woofer 502 and the tweeter 504 to improve sound wave directivity and enhance air loading, respectively. Thus, a system including the waveguide and phase plug assembly 308, the woofer 502, and the tweeter 504 may be referred to as a radiation cell. The radiation cell may be installed in a number of different types of enclosures, for example, a sealed enclosure, a ported enclosure, or an enclosure having passive radiators 306 (as shown in FIGS. 3 and 4).

In an aspect of the present disclosure, a number of radiation cells (e.g., N radiation cells, where N is an integer greater than 1) may be stacked one on top of another in the loudspeaker assembly 100 based on an acoustic performance desired from the loudspeaker assembly 100. Moreover, the radiation cell may not be necessarily positioned at a lower portion of the loudspeaker assembly 100 (as shown in FIG. 3). The radiation cell may be positioned at a middle portion and/or an upper portion of the loudspeaker assembly 100 based on the desired acoustic performance. Also, the relative positions of the down-firing woofer 502 and the up-firing tweeter 504 may be varied within the radiation cell based on the desired acoustic performance.

Figure 11:
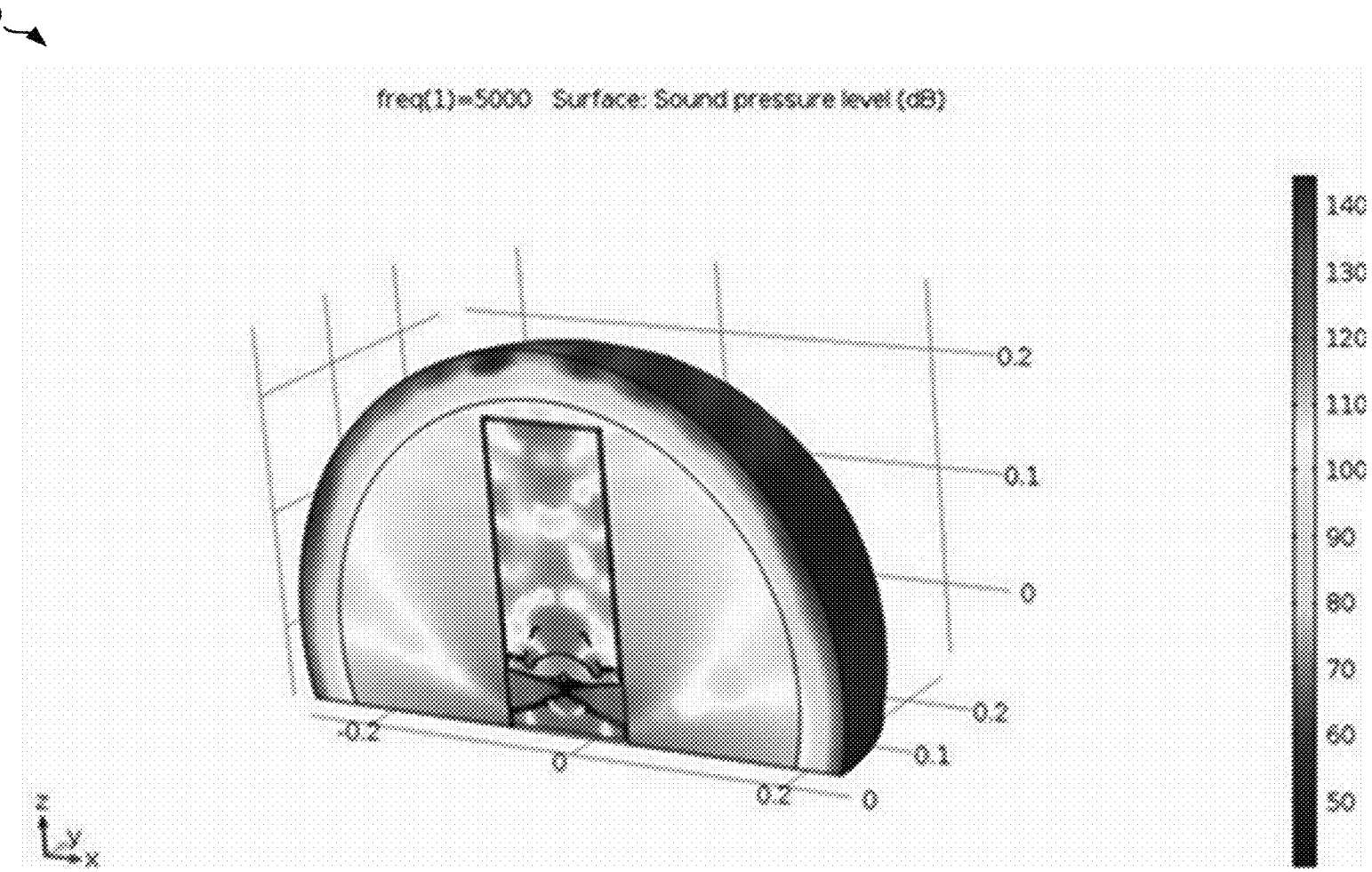
FIG. 11 is a diagram illustrating sound wave radiation generated by the loudspeaker assembly in the x, y, and z axes according to aspects of the present disclosure.
Figure 12:
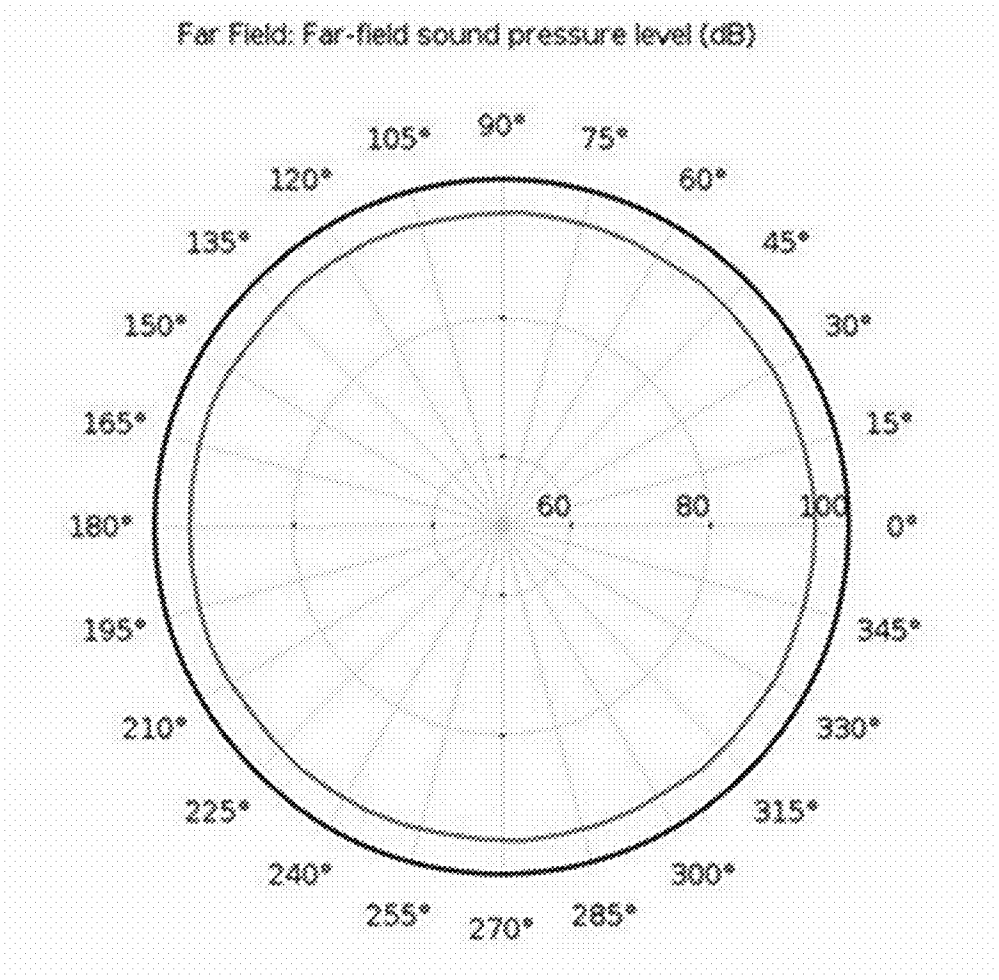
FIG. 12 is a diagram illustrating a directivity of sound waves generated by the loudspeaker assembly in the x-y plane.
Figure 13:
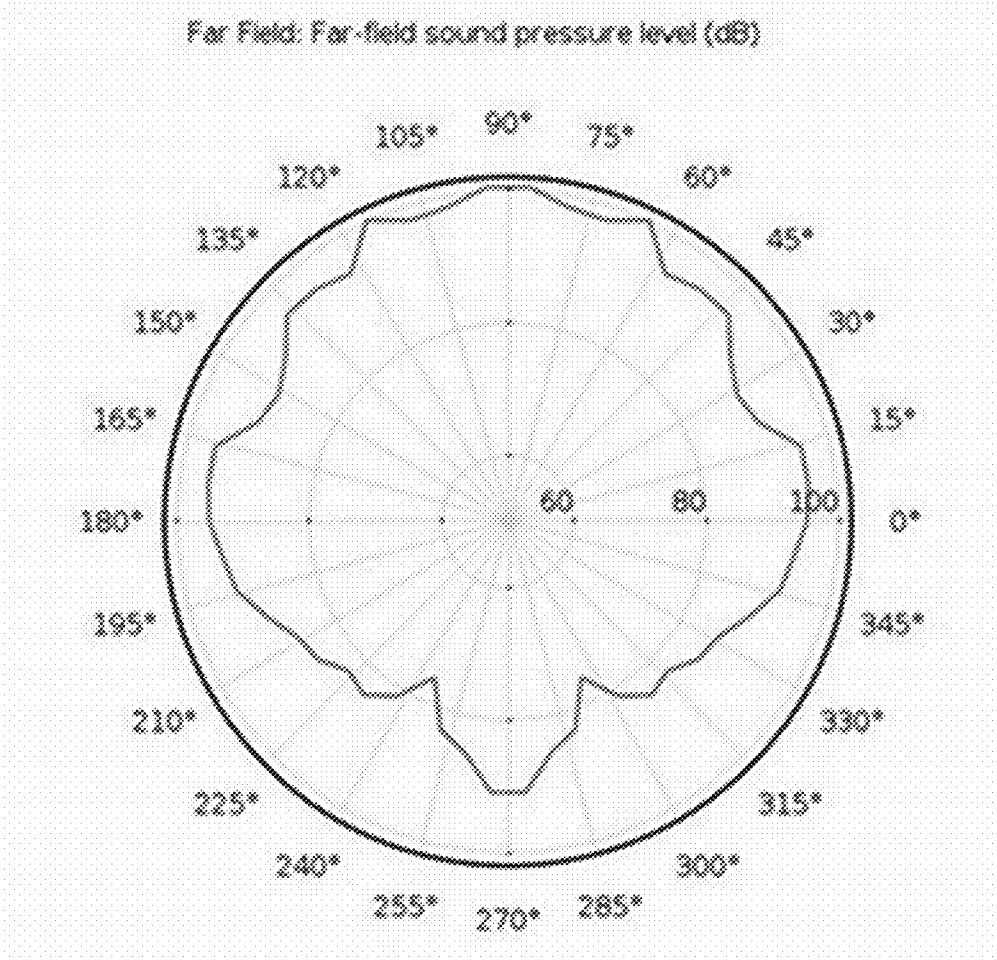
FIG. 13 is a diagram illustrating a directivity of sound waves generated by the loudspeaker assembly in the y-z plane.
Figure 14:
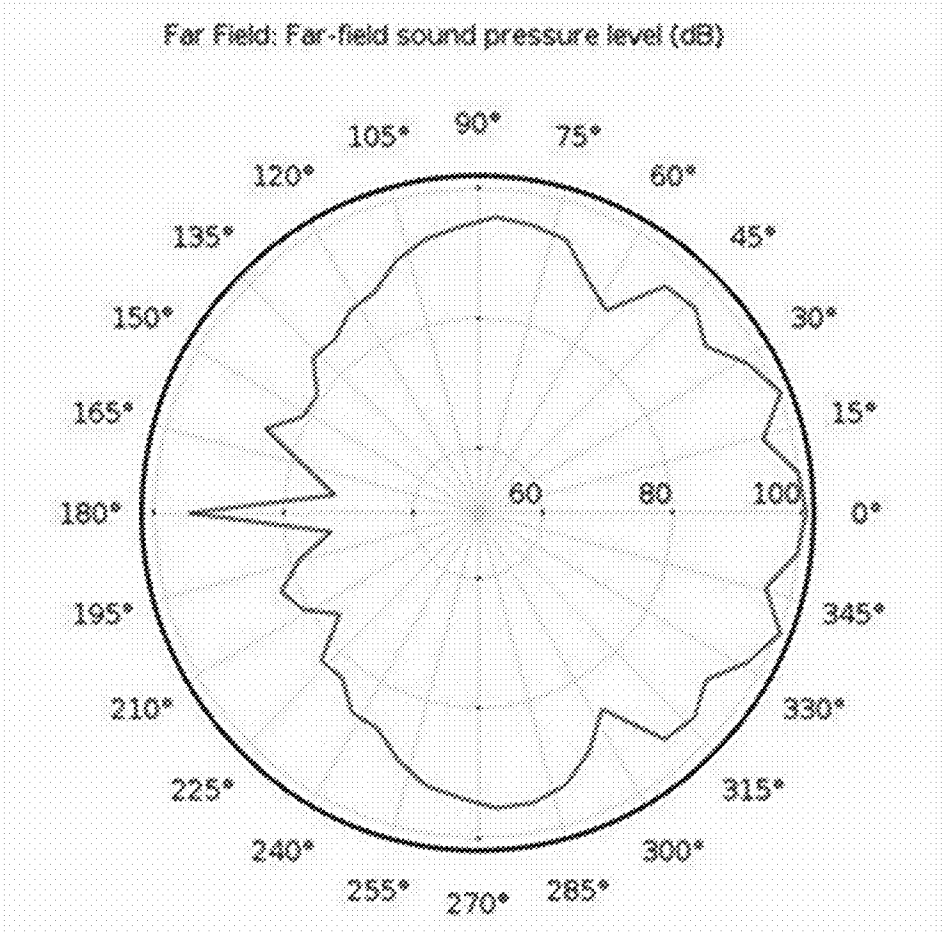
FIG. 14 is a diagram illustrating a directivity of sound waves generated by the loudspeaker assembly in the x-z plane.

FIG. 11 is a diagram 1100 illustrating sound wave radiation generated by the loudspeaker assembly 100 in the x, y, and z axes according to aspects of the present disclosure. FIG. 12 is a diagram 1200 illustrating a directivity of sound waves generated by the loudspeaker assembly 100 in the x-y plane. FIG. 13 is a diagram 1300 illustrating a directivity of sound waves generated by the loudspeaker assembly 100 in the y-z plane. FIG. 14 is a diagram 1400 illustrating a directivity of sound waves generated by the loudspeaker assembly 100 in the x-z plane. As shown in FIG. 12, the loudspeaker assembly 100 is capable of producing a 360-degree sound wave radiation pattern in the x-y plane. In an aspect, the loudspeaker assembly 100 may increase the efficiency of using sound energy by controlling the directivity of the sound wave radiation. As such, the waveguide 506 may include a number of wedge inserts 902 (FIG. 9), as needed, in order to generate a desired directional sound.

In accordance with the present disclosure, a loudspeaker assembly (e.g. loudspeaker assembly 100) for radiating sound waves in an omnidirectional manner is provided. The loudspeaker assembly includes a first electro-acoustic transducer positioned along a first longitudinal axis (e.g., downward-facing electro-acoustic transducer) configured to generate one of sound waves in a first frequency range (e.g., woofer 502 generating low frequency sound waves) or sound waves in a second frequency range (e.g., tweeter 504 generating high frequency sound waves), wherein the first frequency range is lower than the second frequency range. The loudspeaker assembly further includes a second electro-acoustic transducer positioned along a second longitudinal axis (e.g., upward-facing electro-acoustic transducer) configured to generate another one of the sound waves in the second frequency range (e.g., tweeter 504) or the sound waves in the first frequency range (e.g., woofer 502). In an aspect, the first electro-acoustic transducer and the second electro-acoustic transducer face each other and are aligned along a same axis within the loudspeaker assembly. The first electro-acoustic transducer and the second electro-acoustic transducer may be electrically fed in phase.

The loudspeaker assembly further includes a waveguide and phase plug assembly (e.g., waveguide and phase plug assembly 308) that is coupled between the first electro-acoustic transducer and the second electro-acoustic transducer. The waveguide and phase plug assembly may be configured to control a direction in which the sound waves generated by the first electro-acoustic transducer and the second electro-acoustic transducer are radiated. In an aspect, the waveguide and phase plug assembly controls the sound waves generated by the first electro-acoustic transducer and the second electro-acoustic transducer to be radiated in a 360-degree direction (e.g., at low frequencies). The waveguide and phase plug assembly may further be configured to increase impedance matching and air loading of the first electro-acoustic transducer and the second electro-acoustic transducer.

The waveguide and phase plug assembly may include a waveguide (e.g., waveguide 506) and a phase plug (e.g., phase plug 508). The waveguide may be configured to directionally guide the sound waves generated by the first electro-acoustic transducer and the second electro-acoustic transducer. The phase plug may be integrated with the waveguide and configured to equalize path lengths of the sound waves generated by at least one of the first electro-acoustic transducer or the second electro-acoustic transducer. As such, the phase plug may prevent sound wave cancellation by guiding sound waves outward toward a listener rather than allowing the sound waves to interact destructively near a transducer.

The first or second electro-acoustic transducer configured to generate the low frequency sound waves may have a concave shape with respect to the waveguide. The first or second electro-acoustic transducer configured to generate the high frequency sound waves may include a diaphragm (e.g., diaphragm 802). Accordingly, the phase plug may be positioned between the diaphragm of the electro-acoustic transducer generating the high frequency sound waves and the waveguide. Moreover, the waveguide may include a number of wedge inserts (e.g., wedge inserts 902) that control the direction in which the sound waves generated by the first electro-acoustic transducer and the second electro-acoustic transducer are radiated.

In an aspect, the first electro-acoustic transducer, the second electro-acoustic transducer, and the waveguide and phase plug assembly coupled between the first electro-acoustic transducer and the second electro-acoustic transducer constitute a first cell (e.g., radiation cell) within the loudspeaker assembly. Accordingly, the loudspeaker assembly may further including additional cells that may be stacked one by one above or below the first cell. Additional cells may include at least one other electro-acoustic transducer positioned along the first longitudinal axis and configured to generate one of the low frequency sound waves and the high frequency sound waves, at least one other electro-acoustic transducer positioned along the second longitudinal axis and configured to generate another one of the low frequency sound waves and the high frequency sound waves, and at least one other waveguide and phase plug assembly, coupled between the at least one other electro-acoustic transducer positioned along the first longitudinal axis and the at least one other electro-acoustic transducer positioned along the second longitudinal axis, and configured to control a direction in which the sound waves generated by the at least one other electro-acoustic transducer positioned along the first longitudinal axis and the at least one other electro-acoustic transducer positioned along the second longitudinal axis are radiated.

The loudspeaker assembly may further include a speaker enclosure (e.g., speaker enclosure 302) for electrically coupling components of the loudspeaker assembly, one or more passive radiators (e.g., radiators 306) formed at a side portion of the speaker enclosure and configured to tune a frequency response of the sound waves generated by the first electro-acoustic transducer and the second electro-acoustic transducer; and an outer housing (e.g., outer housing 102) for enclosing the first electro-acoustic transducer, the second electro-acoustic transducer, the waveguide and phase plug assembly, the speaker enclosure, and the one or more passive radiators.

Figure 15:
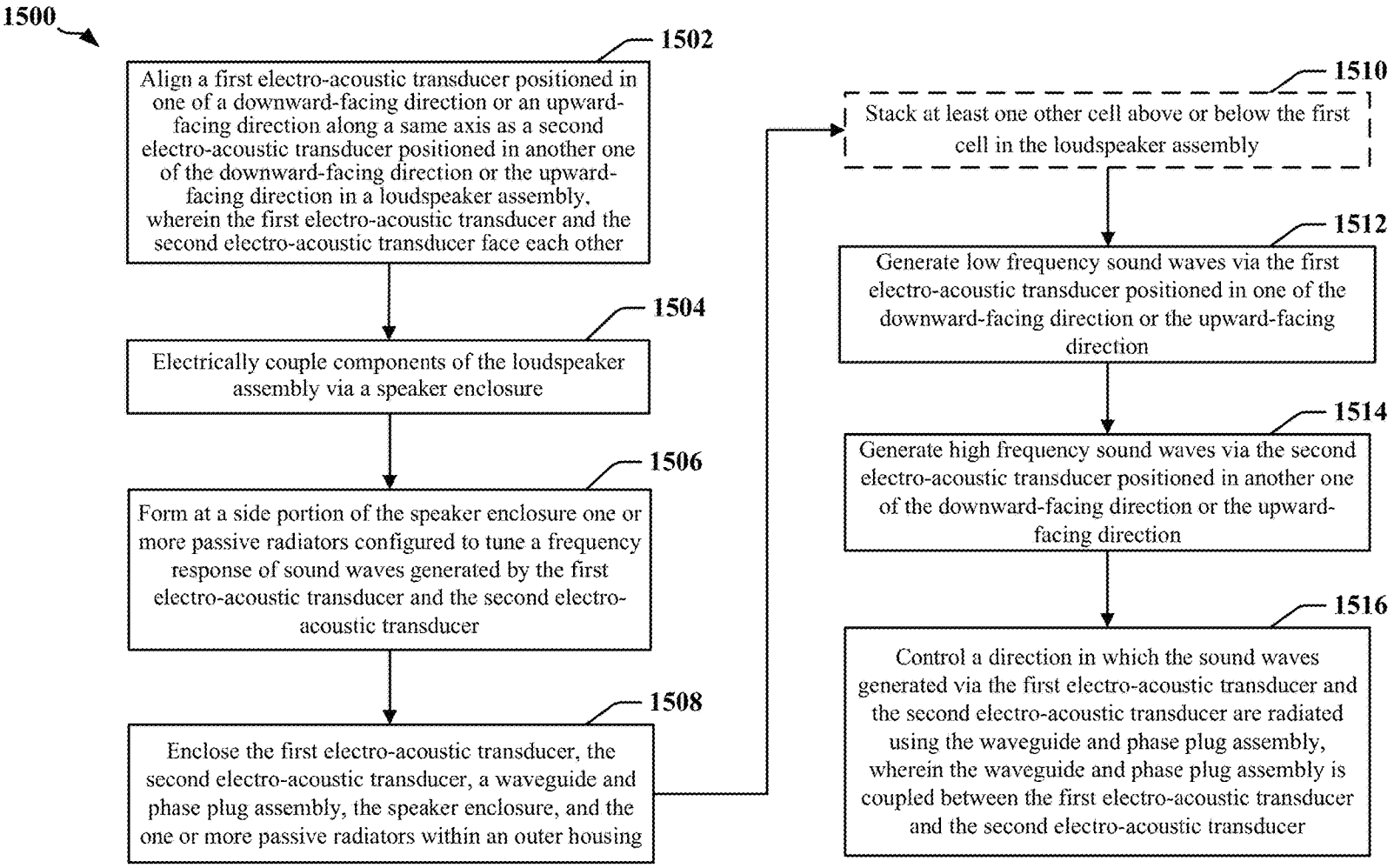
FIG. 15 illustrates a logical flow diagram of an exemplary method for radiating sound waves in an omnidirectional manner via a loudspeaker assembly.

FIG. 15 illustrates a logical flow diagram of an exemplary method 1500 for radiating sound waves in an omnidirectional manner via a loudspeaker assembly.

A first electro-acoustic transducer positioned in one of a downward-facing direction or an upward-facing direction in the loudspeaker assembly may be aligned along a same axis as a second electro-acoustic transducer positioned in another one of the downward-facing direction or the upward-facing direction in the loudspeaker assembly, wherein the first electro-acoustic transducer and the second electro-acoustic transducer face each other 1502. The first electro-acoustic transducer and the second electro-acoustic transducer may be electrically fed in phase.

Components of the loudspeaker assembly may be electrically coupled via a speaker enclosure 1504. Moreover, one or more passive radiators configured to tune a frequency response of sound waves generated by the first electro-acoustic transducer and the second electro-acoustic transducer may be formed at a side portion of the speaker enclosure 1506. The first electro-acoustic transducer, the second electro-acoustic transducer, a waveguide and phase plug assembly, the speaker enclosure, and the one or more passive radiators may be enclosed within an outer housing 1508.

Low frequency sound waves may be generated via the first electro-acoustic transducer positioned in one of the downward-facing direction or the upward-facing direction in the loudspeaker assembly 1512. High frequency sound waves may be generated via the second electro-acoustic transducer positioned in another one of the downward-facing direction or the upward-facing direction in the loudspeaker assembly 1514. Moreover, a direction in which the sound waves generated via the first electro-acoustic transducer and the second electro-acoustic transducer are radiated may be controlled using the waveguide and phase plug assembly 1516. The waveguide and phase plug assembly may be coupled between the first electro-acoustic transducer and the second electro-acoustic transducer.

In an aspect, the waveguide and phase plug assembly controls the sound waves generated by the first electro-acoustic transducer and the second electro-acoustic transducer to be radiated in a 360-degree direction. Moreover, the waveguide and phase plug assembly is configured to increase impedance matching and air loading of the first electro-acoustic transducer and the second electro-acoustic transducer.

In a further aspect, the direction in which the sound waves generated via the first electro-acoustic transducer and the second electro-acoustic transducer are radiated using the waveguide and phase plug assembly is controlled by directionally guiding the sound waves generated by the first electro-acoustic transducer and the second electro-acoustic transducer via a waveguide, and equalizing, via a phase plug integrated with the waveguide, path lengths of the sound waves generated by at least one of the first electro-acoustic transducer or the second electro-acoustic transducer to prevent sound wave cancellation.

The first electro-acoustic transducer may be positioned in the downward-facing direction and has a concave shape with respect to the waveguide. The second electro-acoustic transducer may be positioned in the upward-facing direction and includes a diaphragm. The phase plug may be positioned between the diaphragm and the waveguide. Moreover, the direction in which the sound waves generated by the first electro-acoustic transducer and the second electro-acoustic transducer are radiated may be controlled via a number of wedge inserts formed in the waveguide.

In an aspect, a first cell includes the first electro-acoustic transducer, the second electro-acoustic transducer, and the waveguide and phase plug assembly coupled between the first electro-acoustic transducer and the second electro-acoustic transducer. Accordingly, at least one other cell may optionally be stacked (1510) above or below the first cell in the loudspeaker assembly. The at least one other cell may include at least one other electro-acoustic transducer positioned in one of a downward-facing direction or an upward-facing direction and configured to generate low frequency sound waves, at least one other electro-acoustic transducer positioned in another one of the downward-facing direction or the upward-facing direction and configured to generate high frequency sound waves, and at least one other waveguide and phase plug assembly, coupled between the at least one other downward-facing electro-acoustic transducer and the at least one other upward-facing electro-acoustic transducer, and configured to control a direction in which the sound waves generated by the at least one other downward-facing electro-acoustic transducer and the at least one other upward-facing electro-acoustic transducer are radiated.

It is understood that the specific order or hierarchy of steps in the processes disclosed is an illustration of exemplary approaches. Based upon design preferences, it is understood that the specific order or hierarchy of steps in the processes may be rearranged. Further, some steps may be combined or omitted. The accompanying method claims present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

What is claimed is:

1. A loudspeaker assembly for radiating sound waves in an omnidirectional manner, comprising:

a first electro-acoustic transducer positioned along a first longitudinal axis and configured to generate one of sound waves in a first frequency range or sound waves in a second frequency range, wherein the first frequency range is lower than the second frequency range;

a second electro-acoustic transducer positioned along a second longitudinal axis and configured to generate another one of the sound waves in the first frequency range or the sound waves in the second frequency range; and a waveguide and phase plug assembly, coupled between the first electro-acoustic transducer and the second electro-acoustic transducer, and configured to control a direction in which the sound waves generated by the first electro-acoustic transducer and the second electro-acoustic transducer are radiated, the waveguide having a first point on a first side along the first longitudinal axis and a second point on a second side along the second longitudinal axis, both sides of the waveguide.

2. The loudspeaker assembly of claim 1, wherein the first electro-acoustic transducer and the second electro-acoustic transducer face each other and are aligned along a same axis, and wherein the waveguide and phase plug assembly controls the sound waves generated by the first electro-acoustic transducer and the second electro-acoustic transducer to be radiated in a 360-degree direction.

3. The loudspeaker assembly of claim 1, wherein the waveguide and phase plug assembly is further configured to increase air loading of at least one of the first electro-acoustic transducer and the second electro-acoustic transducer.

4. The loudspeaker assembly of claim 1, wherein the waveguide and phase plug assembly includes:

a waveguide configured to directionally guide the sound waves generated by the first electro-acoustic transducer and the second electro-acoustic transducer; and a phase plug, integrated with the waveguide, and configured to equalize path lengths of the sound waves generated by at least one of the first electro-acoustic transducer or the second electro-acoustic transducer to prevent sound wave cancellation.

5. The loudspeaker assembly of claim 4, wherein the first electro-acoustic transducer is configured to generate the sound waves in the first frequency range and has a concave shape with respect to the waveguide.

6. The loudspeaker assembly of claim 4, wherein the second electro-acoustic transducer is configured to generate the sound waves in the second frequency range and includes a diaphragm, and wherein the phase plug is disposed between the diaphragm and the waveguide.

7. The loudspeaker assembly of claim 4, wherein the waveguide includes a number of wedge inserts that control the direction in which the sound waves generated by the first electro-acoustic transducer and the second electro-acoustic transducer are radiated.

8. The loudspeaker assembly of claim 1, wherein a first cell includes the first electro-acoustic transducer, the second electro-acoustic transducer, and the waveguide and phase plug assembly coupled between the first electro-acoustic transducer and the second electro-acoustic transducer, the loudspeaker assembly further including at least one other cell stacked above or below the first cell.

9. The loudspeaker assembly of claim 8, the at least one other cell including:

at least one other electro-acoustic transducer positioned along the first longitudinal axis and configured to generate one of the sound waves in the first frequency range or the sound waves in the second frequency range;

at least one other electro-acoustic transducer positioned along the second longitudinal axis and configured to generate another one of the sound waves in the first frequency range or the sound waves in the second frequency range; and at least one other waveguide and phase plug assembly, coupled between the at least one other electro-acoustic transducer positioned along the first longitudinal axis and the at least one other electro-acoustic transducer positioned along the second longitudinal axis, and configured to control a direction in which the sound waves generated by the at least one other electro-acoustic transducer positioned along the first longitudinal axis and the at least one other electro-acoustic transducer positioned along the second longitudinal axis are radiated.

10. The loudspeaker assembly of claim 1, further comprising:

a speaker enclosure for electrically coupling components of the loudspeaker assembly;

one or more passive radiators formed at a side portion of the speaker enclosure and configured to tune a frequency response of the sound waves generated by the first electro-acoustic transducer and the second electro-acoustic transducer; and an outer housing for enclosing the first electro-acoustic transducer, the second electro-acoustic transducer, the waveguide and phase plug assembly, the speaker enclosure, and the one or more passive radiators.

11. A loudspeaker assembly for radiating sound waves in an omnidirectional manner, comprising:

first sound generating means for generating sound waves in a first frequency range, the first sound generating means positioned along one of a first longitudinal axis or a second longitudinal axis in the loudspeaker assembly;

second sound generating means for generating sound waves in a second frequency range the second sound generating means positioned along another one of the first longitudinal axis or the second longitudinal axis in the loudspeaker assembly, wherein the first frequency range is lower than the second frequency range; and a waveguide and phase plug assembly for controlling a direction in which the sound waves generated by the first sound generating means and the second sound generating means are radiated, wherein the waveguide and phase plug assembly is coupled between the first sound generating means and the second sound generating means, the waveguide having a first point on a first side along the first longitudinal axis and a second point on a second side along the second longitudinal axis, both sides of the waveguide.

12. The loudspeaker assembly of claim 11, wherein the first sound generating means is aligned along a same axis as the second sound generating means in the loudspeaker assembly, wherein the first sound generating means and the second sound generating means face each other, and wherein the controlling means controls the sound waves generated by the first sound generating means and the second sound generating means to be radiated in a 360-degree direction.

13. The loudspeaker assembly of claim 11, wherein the controlling means is configured to increase air loading of at least one of the first sound generating means and the second sound generating means.

14. The loudspeaker assembly of claim 11, wherein the controlling means includes:

guiding means for directionally guiding the sound waves generated by the first sound generating means and the second sound generating means; and equalizing means, integrated with the guiding means, for equalizing path lengths of the sound waves generated by at least one of the first sound generating means or the second sound generating means to prevent sound wave cancellation.

15. The loudspeaker assembly of claim 14, wherein the first sound generating means is positioned along the first longitudinal axis and has a concave shape with respect to the guiding means.

16. The loudspeaker assembly of claim 14, wherein the second sound generating means is positioned along the second longitudinal axis and includes a diaphragm, and the equalizing means is positioned between the diaphragm and the guiding means.

17. The loudspeaker assembly of claim 14, wherein the direction in which the sound waves generated by the first sound generating means and the second sound generating means are radiated is controlled via a number of wedge inserts formed in the guiding means.

18. The loudspeaker assembly of claim 11, wherein a first cell includes the first sound generating means, the second sound generating means, and the controlling means coupled between the first sound generating means and the second sound generating means, and wherein at least one other cell is stacked above or below the first cell in the loudspeaker assembly.

19. The loudspeaker assembly of claim 18, wherein the at least one other cell includes:

at least one other sound generating means positioned along one of the first longitudinal axis or the second longitudinal axis for generating the sound waves in the first frequency range;

at least one other sound generating means positioned in another one of the first longitudinal axis or the second longitudinal axis for generating the sound waves in the second frequency range; and at least one other controlling means, coupled between the at least one other sound generating means for generating the sound waves in the first frequency range and the at least one other sound generating means for generating the sound waves in the second frequency range, and configured to control a direction in which the sound waves generated by the at least one other sound generating means for generating the sound waves in the first frequency range and the at least one other sound generating means for generating the sound waves in the second frequency range are radiated.

20. The loudspeaker assembly of claim 11, further comprising:

enclosure means for electrically coupling components of the loudspeaker assembly;

tuning means, formed at a side portion of the enclosure means, for tuning a frequency response of the sound waves generated by the first sound generating means and the second sound generating means; and housing means for enclosing the first sound generating means, the second sound generating means, the controlling means, the enclosure means, and the tuning means.

* * * * *